US006797905B1

(12) United States Patent
Wang et al.

(10) Patent No.: US 6,797,905 B1
(45) Date of Patent: Sep. 28, 2004

(54) ROCKER SWITCH

(75) Inventors: Yung-Hui Wang, Taipei Hsien (TW); Hui-Chun Hsu, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/743,431

(22) Filed: Dec. 23, 2003

(51) Int. Cl.[7] ..... H01H 3/00

(52) U.S. Cl. ..... 200/339; 200/553; 200/559; 200/6 R; 200/405

(58) Field of Search ..... 200/339, 553, 200/558, 559, 6 R, 6 B, 16 C, 16 D, 405

(56) References Cited

U.S. PATENT DOCUMENTS 4,431,880 A 2/1984 Ives
5,293,507 A * 3/1994 Hayakawa ..... 200/244
5,735,392 A * 4/1998 Shirasaka ..... 200/553
5,950,812 A 9/1999 Tanacan et al.
6,339,201 B1 * 1/2002 Balaban et al. ..... 200/339
6,559,393 B2 * 5/2003 Nishikawa ..... 200/6 R
6,576,466 B2 * 6/2003 Jungfer et al. ..... 435/372.3

* cited by examiner

*Primary Examiner*—Kyung Lee
(74) *Attorney, Agent, or Firm*—Birch, Stewart, Kolasch & Birch, LLP

(57) ABSTRACT

This invention discloses a rocker switch which provides a reliable movement and a heat-resistant rocker switch by redesigning the position holding mechanism. The rocker switch of the invention comprises: a common contact point, a close circuit contact point, a movable contact point permanently coupled to the common contact point, a rocking switch connecting to the movable contact point and rocking between a close circuit position and an open circuit position, and a position holding mechanism having a spring and an extension rod coupled to one end of the spring. The extension rod is used to change the position of the force acting between the spring and the rocking button and the force acting on the spring in order to improve the life of the spring and increase heat resistance.

4 Claims, 2 Drawing Sheets

ROCKER SWITCH

FIELD OF THE INVENTION

The present invention relates to power switches, and more particularly to a power switch equipped with a position holding mechanism that comprises a spring and an extension rod.

BACKGROUND OF THE INVENTION

The main usage of a power switch is to control the power to open and close a circuit. The power switch can be divided into different types according to structure, such as the common push switch and rocker switch.

Please refer to FIG. 1 for a cross-sectional view of a conventional rocker switch, which comprises a common contact point 70, a closed circuit contact point 71, a movable contact point 72 permanently coupled to the common contact point 70, a rocking button 73 for coupling the movable contact point 72 and selectively rocking the movable contact point 72 between a close circuit position and an open circuit position, and a position holding spring 75. Such a position holding spring 75 is a compressed spring with one end passing into the bottom 74 of the rocking button 73 and the other end pressing against the movable contact point 72. Regardless of the rocking button 73 position either set to the close circuit position (i.e. the position where the close circuit contact point is touching the movable contact point) or the open circuit position (i.e. the position where the open circuit contact point is not touching the contact point), the position holding spring 75 is compressed and accumulates with energy, and a deformation is produced by twisting the position holding spring 75 along the axial direction. In FIG. 1, the position holding spring 75 produces a reaction due to the compression, and produces a pushing force at the point P of the rocking button 73. Such pushing force pushes the rocking button 73 to rock about its pivotal axis, and the rocking button 73 is pushed by the position holding spring 75 to stop when one of its sides presses against the bottom base 76 of the rocker switch. Such relation will be changed alternatively under the operation of repeatedly switching the rocking button 73, and the movable contact point 72 will be pushed to the close circuit position (i.e. the position where the close circuit contact point is in touch with the movable contact point) or the open circuit position (i.e. the position where the open circuit contact point is in touch with the movable contact point) as the position holding spring 75 is twisted and deformed repeatedly.

However, the position holding spring 75 according to the aforementioned prior art has two main functions: one is to use a rebounding force produced by the permanent compression to push the rocking button 73 and select the close circuit position or open circuit position; and the other is to carry out the mission of flipping the movable contact point 72 when the position holding spring 75 is twisted to deform repeatedly. If such rocker switch is used in an environment of higher temperature, such as being installed in an oven, the repeated twisting and deformation will cause a permanent deformation to the compressed spring very easily. Therefore, the rocker switch cannot be kept in the close circuit position or an open circuit position. After a long-time use, the position holding spring 75 is loosened and the rocker switch no longer can keep a safe distance (such as 3 mm according to the European safety regulation) between the movable contact point and the close circuit contact point even the rocker switch is set to the close circuit position. Further, there are prior arts as disclosed in U.S. Pat. Nos. 4,431,880 and 5,950,812 teaching more complicated structures of the rocker switch.

SUMMARY OF THE INVENTION

The primary objective of the present invention is to provide a rocker switch with good heat-resistance. The rocker switch according to the present invention redesigns the position holding mechanism to improve the reliability of the movement and the heat-resistance of the rocker switch. For the position holding mechanism of the invention, an extension rod with one end passing into a rocking button and the other end connecting to a spring are used to change the position of the force acting between the spring and the rocking button and the force acting on the spring in order to improve the life of the spring and the heat resistance.

Another objective of the present invention is to provide a rocker switch with a high reliability. The position holding mechanism designed for the invention includes an extension rod with one end passing into the rocking button, and the other end of the extension rod and one end of the spring are extended into a movable contact point. Therefore, the extension rod will directly link the contact points to assure the reliability of movement when the rocking button is clicked.

To make it easier for our examiner to understand the objective of the invention, its structure, features, and performance, we use a preferred embodiment together with the attached drawings for the detailed description of the invention.

DETAILED DESCRIPTION OF THE PREFERRED EMBODIMENTS

Figure 2:
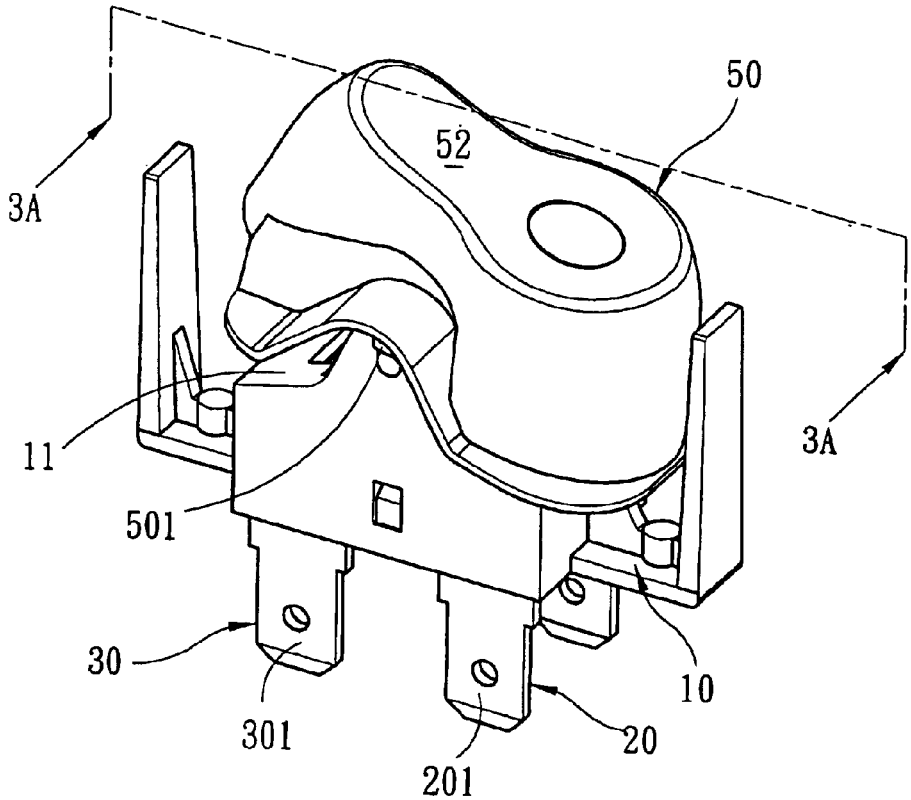
FIG. 2 is a perspective view of the rocker switch of the present invention.
Figure 3A:
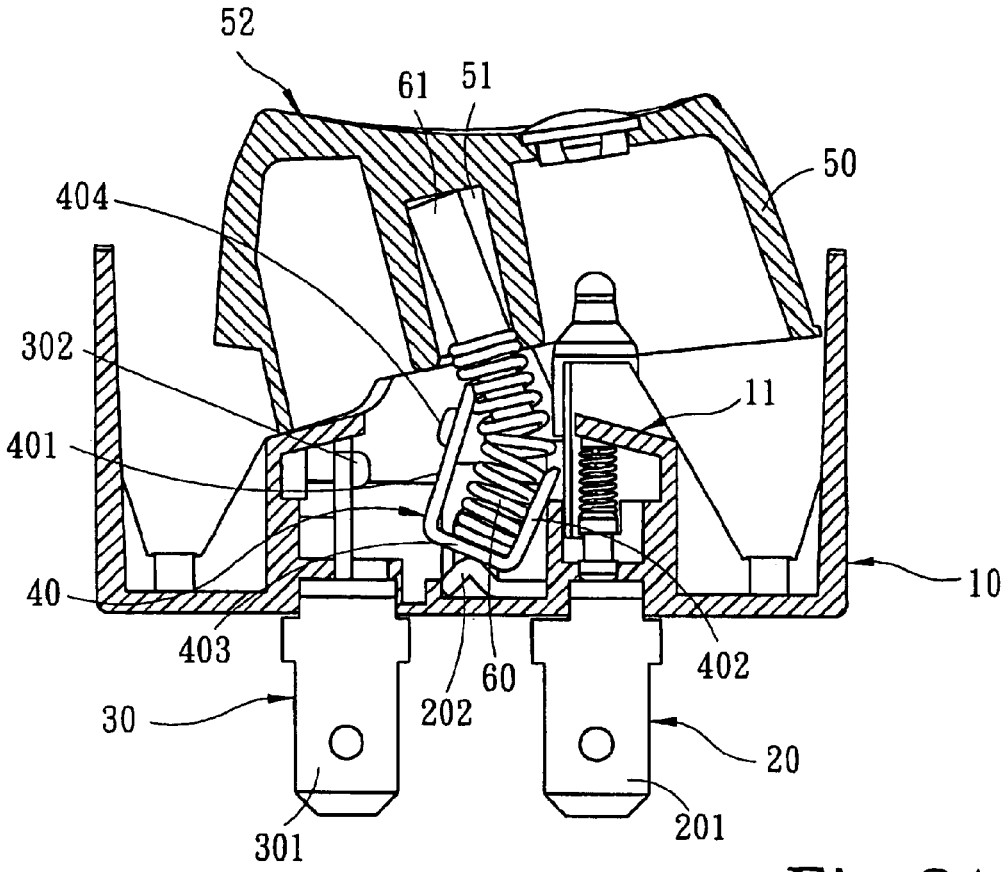
FIG. 3A is a cross-sectional view of the section 3A—3A of FIG. 2 illustrating the separation of the close circuit contact point and the movable contact point when the rocker switch is set to the close circuit position.

Please refer to FIGS. 2 and 3A for the rocker switch of the present invention, basically having its components installed on a base 10, and these components include:

- a common contact pin 20, which is a metal component, having an external connecting section 201 passing through the bottom of the base 10 for connecting to an electric wire, and a common contact point 202 disposed on the surface of the inner side of the bottom of the base 10;
- a close circuit contact pin 30, which is also a metal component, having an external connecting pin 301 passing through the bottom of the base 10 for connecting an electric wire, and a close circuit contact point 302 disposed on the surface of the inner side of the base 10;
- a movable contact pin 40, which is also a metal component, having a first sidewall 401, a second sidewall 402, a bottom plate 403 connecting the first sidewall 401 and the second sidewall 402, a gap between the first sidewall 401 and the second sidewall 402, and a movable contact point 404 protrudes from the surface on the first sidewall facing the close circuit contact point 302, wherein the bottom plate 403 is permanently in contact with a common contact point 202, and the movable contact pin 40 can use the common contact point 202 as the fulcrum to rock itself to contact the close circuit contact point 302 with the movable contact point 404 to define a close circuit position (see FIG. 3B) or separate the close circuit contact point 302 from the movable contact point 404 to define an open circuit position (see FIG. 3A);

a rocking button 50, pivotally coupled to a base 10 with a pivotal axis 501 and having a pressing surface 52 for controlling the rocking button 50 to rock itself about the pivotal axis 501 and pressing one end of the pressing surface 52; and a position holding mechanism, comprising a spring 60 and an extension rod 61, and one end of the extension rod 61 being coupled to one end of the spring 60 and extended between the first sidewall 401 and the second sidewall 402 of the movable contact pin 40, and the one end of the spring 60 preferably connected to one end of the extension rod 61, and the spring 60 being a compressed spring with one end pressing against the bottom plate 403 of the movable contact pin 40 when the spring 60 is compressed.

Figure 1:
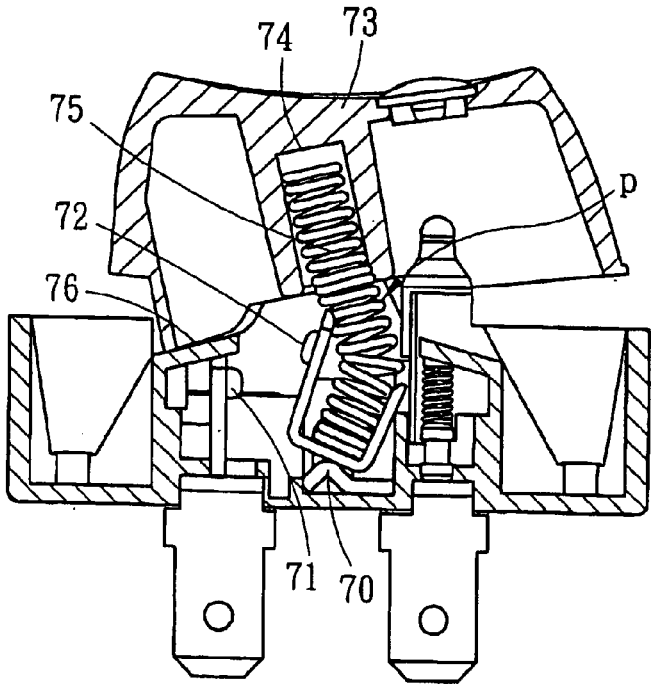
Fig.1 PRIOR ART
FIG. 1 is a cross-sectional view of a prior-art rocker switch.

In FIG. 3A, if the rocker switch is set to open circuit status (i.e. the position of separating the close circuit contact point from the movable contact point), the spring 60 will produce a pushing force acting on the extension rod 61 due to the reaction produced by the compression of the spring 60. Since the extension rod 61 passes through a hole 51 at the bottom of the rocking button 50, the position of the force acting between the spring 60 and the rocking button 50 will be shifted to exterior of the hole 51. Unlike the prior-art technology shown in FIG. 1, the present invention can shorten the length of the spring 60 and reduce the adverse effect of the heat on the spring 60 to improve the life of the spring 60 and its heat resistance. The pushing force of the spring 60 pushes the rocking button 50 about its pivotal axis 501 to produce a rocking movement. The rocking movement will be stopped by a blocking edge 11 disposed on the base 10 of the rocker switch when the rocking button 50 pushed by the spring 60 presses on one side of the blocking edge 11.

Figure 3B:
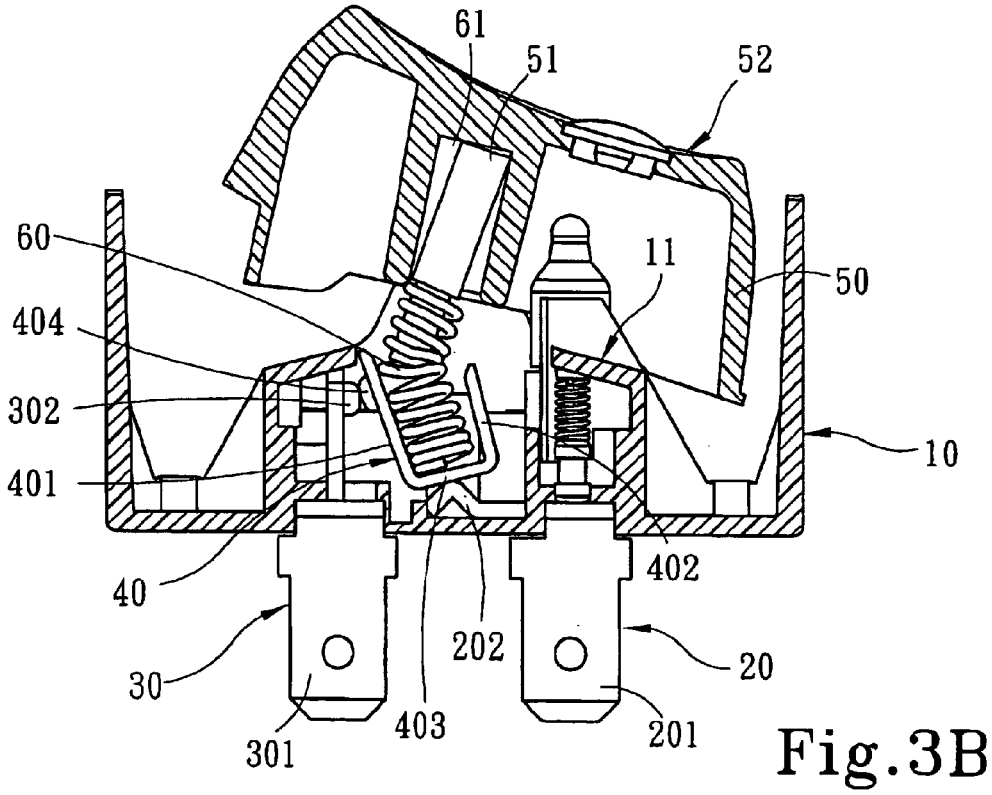
FIG. 3B is a view of the successive movements of contacting the close circuit contact point with the movable contact point when the rocker switch is set to close.

If the right side of the pressing surface 52 of the rocking button 50 is pressed, the rocking button 50 will rock itself about the pivotal axis 501 into a close circuit position (as shown in FIG. 3B). Since the extension rod 61 of the invention passes into the rocking button 50 and its end connected to the spring 60 extends into a position between the first sidewall 401 and the second sidewall 402 of the movable contact pin 40, therefore when the rocking button 50 is clicked, the extension rod 61 directly drives the movable contact point 404 to a close circuit position by moving the close circuit contact point 302 to contact with the movable contact point 404 in order to ensure the reliability of the movement. In a preferred embodiment of this invention, the internal diameter of a hole 51 disposed at the bottom of the rocking button 50 is slightly larger than the external diameter of the extension rod 61, so that the force acting between the spring 60 and the rocking button 50 increases with respect to the arm of moment about the pivotal axis 501 to improve the stability of the rocking button 50 to set the rocker switch to the close circuit position or open circuit position.

What is claimed is:

1. A rocker switch, comprising:

a base, having a blocking edge;

a common pin, having a common contact point and being fixed to said base;

a close circuit pin, having a close circuit contact point, and being fixed to said base;

a movable contact pin, permanently in contact with said common contact point and having a movable contact point, and said movable contact pin capable of selectively rocking itself into a close circuit position by making contact between said close circuit contact point and said movable contact point and to an open circuit position by separating said close circuit contact point from said movable contact point;

a rocking button, using a pivotal axis disposed on said base to produce a rocking movement about said pivotal axis; and a position holding mechanism, comprising a spring and an extension rod, with one end of said extension rod passing into a hole disposed at the bottom of said rocking button, and the other end of said extension rod coupled to one end of said spring and extending to a position for driving said movable contact pin to perform a rocking movement, and one end of said spring pressing against said movable contact pin, and permanently maintaining said spring in a compressed and deformed status, and the resilience of said spring pushing said rocking button to produce a rocking movement about said pivotal axis, thereby one side of said rocking button pressing against said blocking edge.

2. The rocker switch of claim 1, wherein said movable contact pin comprises a first sidewall and a second sidewall coupled to said first sidewall, a bottom plate disposed on said second sidewall, a gap between said first and second sidewalls for receiving the extension rod, and a movable contact point disposed on said first sidewall facing the surface on a side of said close circuit contact point.

3. The rocker switch of claim 1, wherein said spring is a compressed spring.

4. The rocker switch of claim 1, wherein said hole at the bottom of said rocking button has an internal diameter slightly larger than the external diameter of said extension rod.

* * * * *